US011591837B2

(12) United States Patent
He et al.

(10) Patent No.: US 11,591,837 B2
(45) **Date of Patent: *Feb. 28, 2023**

(54) REFRIGERATOR

(71) Applicant: QINGDAO HAIER JOINT STOCK CO., LTD., Qingdao (CN)

(72) Inventors: Guoshun He, Qingdao (CN); Enpin Xia, Qingdao (CN); Hao Zhang, Qingdao (CN); Xiaobing Zhu, Qingdao (CN)

(73) Assignee: QINGDAO HAIER JOINT STOCK CO., LTD., Qingdao (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/401,272

(22) Filed: Aug. 12, 2021

(65) Prior Publication Data

US 2021/0372181 A1 Dec. 2, 2021

Related U.S. Application Data

(63) Continuation of application No. 16/323,255, filed on Feb. 4, 2019, now Pat. No. 11,118,384.

(51) Int. Cl.
*E05D 7/04* (2006.01)
*E05D 3/18* (2006.01)
(Continued)

(52) U.S. Cl.
CPC ..... *E05D 7/0407* (2013.01); *E05D 3/18* (2013.01); *E05D 5/046* (2013.01); *E05D 5/14* (2013.01);
(Continued)

(58) Field of Classification Search
CPC . E05D 7/0407; E05D 11/1007; F25D 23/028; F25D 2323/024; E05Y 2600/20;
(Continued)

(56) References Cited

U.S. PATENT DOCUMENTS 1,075,130 A * 10/1913 Streberger ..... E05D 3/18 5/47
2,867,839 A * 1/1959 Squire ..... E05D 3/18 16/358
(Continued)

FOREIGN PATENT DOCUMENTS

CA 2334055 A1 8/2002
CH 387576 A5 1/1997
(Continued)

OTHER PUBLICATIONS

Translation JP2009097812A, 11 pages (Year: 2009).*

*Primary Examiner* — Andrew M Roersma
(74) *Attorney, Agent, or Firm* — Cheng-Ju Chiang

(57) ABSTRACT

The present invention provides a refrigerator, comprising a refrigerator body and a door body. A hinge body is disposed on the refrigerator body. A first hinge shaft and a second hinge shaft are disposed on the hinge body. A first guide groove and a second guide groove are formed in the door body. The first hinge shaft is located in the first guide groove and the second hinge shaft is located in the second guide groove. During opening of the door body, the first guide groove moves relative to the first hinge shaft and the second guide groove moves relative to the second hinge shaft, the first hinge shaft applies an acting force to the first guide groove to drive the end, away from the first guide groove, of the second guide groove to approach the second hinge shaft, so that the door body is displaced in a horizontal direction.

17 Claims, 12 Drawing Sheets

(51) Int. Cl.

| | |
|---|---|
| ***E05D 5/14*** | (2006.01) |
| ***E05D 7/081*** | (2006.01) |
| ***E05D 11/10*** | (2006.01) |
| ***E05D 5/04*** | (2006.01) |
| ***E05D 15/56*** | (2006.01) |
| ***F25D 11/02*** | (2006.01) |
| ***F25D 23/10*** | (2006.01) |
| ***F25D 11/00*** | (2006.01) |
| ***E05D 11/06*** | (2006.01) |
| ***E05F 1/00*** | (2006.01) |
| ***F25D 23/02*** | (2006.01) |

(52) U.S. Cl.
CPC ..... *E05D 7/081* (2013.01); *E05D 11/06* (2013.01); *E05D 11/1007* (2013.01); *E05D 11/1028* (2013.01); *E05D 15/56* (2013.01); *E05F 1/00* (2013.01); *F25D 11/00* (2013.01); *F25D 11/02* (2013.01); *F25D 23/028* (2013.01); *F25D 23/10* (2013.01); *E05Y 2600/20* (2013.01); *E05Y 2600/324* (2013.01); *E05Y 2800/102* (2013.01); *E05Y 2900/31* (2013.01); *F25D 2323/024* (2013.01)

(58) Field of Classification Search
CPC ..... E05Y 2600/324; E05Y 2800/102; E05Y 2900/31
See application file for complete search history.

(56) References Cited

U.S. PATENT DOCUMENTS

| | | | | | |
|---|---|---|---|---|---|
| 3,001,225 | A * | 9/1961 | Squire | E05D 1/04 16/358 | |
| 3,065,498 | A * | 11/1962 | Johnson | E05D 3/18 16/359 | |
| 3,083,403 | A * | 4/1963 | Van Noord | E05D 3/18 16/361 | |
| 6,493,906 | B2 * | 12/2002 | Matteau | E05D 3/18 16/358 | |
| 8,303,059 | B2 * | 11/2012 | Darney | E05D 3/18 312/405 | |
| 2002/0104191 | A1 | 8/2002 | Matteau | | |
| 2003/0132689 | A1 * | 7/2003 | Shin | F25D 23/028 312/405 | |
| 2006/0143860 | A1 | 7/2006 | Park et al. | | |

FOREIGN PATENT DOCUMENTS

| | | | | |
|---|---|---|---|---|
| CN | 87207236 | U | 3/1988 | |
| CN | 1432781 | A | 7/2003 | |
| CN | 2723923 | Y | 9/2005 | |
| CN | 1860279 | A | 11/2006 | |
| CN | 101501288 | A | 8/2009 | |
| CN | 102425351 | A | 4/2012 | |
| CN | 102587760 | A | 7/2012 | |
| CN | 202393143 | U | 8/2012 | |
| CN | 102720413 | A | 10/2012 | |
| CN | 202611405 | U | 12/2012 | |
| CN | 103307840 | A | 9/2013 | |
| CN | 204024284 | U | 12/2014 | |
| CN | 104350293 | A | 2/2015 | |
| CN | 105484591 | A | 4/2016 | |
| CN | 105507706 | A | 4/2016 | |
| CN | 105588398 | A | 5/2016 | |
| CN | 106091533 | A | 11/2016 | |
| CN | 205747665 | U | 11/2016 | |
| CN | 106196819 | A | 12/2016 | |
| CN | 205909611 | U | 1/2017 | |
| CN | 106593160 | A | 4/2017 | |
| CN | 106610167 | A | 5/2017 | |
| CN | 106869655 | A | 6/2017 | |
| CN | 206257873 | U | 6/2017 | |
| CN | 107288463 | A | 10/2017 | |
| CN | 107288464 | A | 10/2017 | |
| CN | 107288465 | A | 10/2017 | |
| CN | 107288466 | A | 10/2017 | |
| CN | 107289719 | A | 10/2017 | |
| CN | 107289720 | A | 10/2017 | |
| CN | 107388707 | A | 11/2017 | |
| CN | 107388708 | A | 11/2017 | |
| CN | 107489326 | A | 12/2017 | |
| CN | 107489327 | A | 12/2017 | |
| CN | 107489328 | A | 12/2017 | |
| CN | 107489329 | A | 12/2017 | |
| CN | 107503608 | A | 12/2017 | |
| CN | 107514197 | A | 12/2017 | |
| CN | 107514863 | A | 12/2017 | |
| DE | 1708254 | A1 | 9/1971 | |
| DE | 102005006531 | A1 * | 8/2006 | E05D 3/18 |
| EP | 3026375 | A1 | 6/2016 | |
| EP | 3040661 | A1 | 7/2016 | |
| GB | 2439328 | A | 12/2007 | |
| JP | 63-123976 | A | 5/1988 | |
| JP | 9-33162 | A | 2/1997 | |
| JP | 2009-97812 | A | 5/2009 | |
| KR | 1997-0066462 | A | 10/1997 | |
| KR | 0142057 | B1 | 3/1998 | |
| KR | 0168270 | B1 | 1/1999 | |
| KR | 10-2015-0109806 | A | 10/2015 | |
| KR | 10-2015-0120674 | A | 10/2015 | |
| WO | WO-2004090270 | A2 * | 10/2004 | E05D 3/18 |
| WO | 2015/029000 | A1 | 3/2015 | |

* cited by examiner

REFRIGERATOR

CROSS REFERENCE TO RELATED APPLICATIONS

The present application is a continuation application of U.S. patent application Ser. No. 16/323,255, filed on Feb. 4, 2019, which is a 35 U.S.C. § 371 National Phase conversion of International (PCT) Patent Application No. PCT/CN2016/112818, filed on Dec. 29, 2016, which claims priority to Chinese Patent Application No. 201610642524.X, filed to the Chinese Patent Office on Aug. 5, 2016 and titled "Refrigerator", the content of which is incorporated herein by reference in its entirety.

TECHNICAL FIELD

The present invention belongs to the field of household appliance technology and particularly relates to a refrigerator.

BACKGROUND

Currently, a refrigerator adopts a single-axis hinge. A door body conducts a circular motion around a fixed point of the hinge to be opened or closed. With reference to FIG. 1, during opening of the door body, a corner portion formed by a vertical edge and a horizontal edge, close to the hinge, of the door body moves out of an extension line where a vertical edge of a refrigerator body of the refrigerator is located. In this case, owing to the design of the hinge, an opening angle of the door body of the refrigerator is limited when a gap between refrigerator housing and a wall is relatively smaller or the refrigerator is configured as an embedded refrigerator.

SUMMARY

One objective of the present invention is to provide a refrigerator for solving the above-mentioned problem.

To realize this objective, the present invention provides a refrigerator.

The refrigerator comprises a refrigerator body and a door body.

A hinge body is disposed on the refrigerator body. A first hinge shaft and a second hinge shaft are disposed on the hinge body.

A first guide groove and a second guide groove are formed in the door body. After installation of the door body and the refrigerator body, the first hinge shaft is located in the first guide groove and the second hinge shaft is located in the second guide groove.

During opening of the door body, the first guide groove moves relative to the first hinge shaft, and the second guide groove moves relative to the second hinge shaft. During movement, the first hinge shaft applies an acting force to the first guide groove to drive the end, away from the first guide groove, of the second guide groove to gradually approach the second hinge shaft, so that the door body is displaced in a horizontal direction.

As an improvement of the present invention, the first guide groove is configured as substantially L-shaped and comprises a sliding groove A and a sliding groove B. The second guide groove is oblong. The end, close to the sliding groove A of the first guide groove, of the second guide groove is defined as an end C. The end, away from the sliding groove A of the first guide groove, of the second guide groove is defined as an end D.

As a further improvement of the present invention, when the door body is in a closed state, the first hinge shaft is located at the end, away from the sliding groove B, of the sliding groove A of the first guide groove. The second hinge shaft is at a distance away from the end C and the end D of the second guide groove.

As a further improvement of the present invention, when an opening angle of the door body gradually approaches 90°, the first hinge shaft is located in the sliding groove A of the first guide groove and gradually approaches the sliding groove B, and the end D of the second guide groove gradually approaches the second hinge shaft.

As a further improvement of the present invention, when the opening angle of the door body is 90°, the first hinge shaft is located at a joint of the sliding groove A and the sliding groove B of the first guide groove, and the second hinge shaft is located at the end C of the second guide groove.

As a further improvement of the present invention, when the opening angle of the door body is greater than 90°, the first hinge shaft is located in the sliding groove B of the first guide groove, and the second hinge shaft is located at the end C of the second guide groove.

As a further improvement of the present invention, a connecting line of centers of the first hinge shaft and the second hinge shaft is in a horizontal direction.

As a further improvement of the present invention, a radius of the first hinge shaft is smaller than that of the second hinge shaft.

As a further improvement of the present invention, the end C and the end D of the second guide groove are connected by two parallel lines between which the distance is greater than or equal to a diameter of the second hinge shaft.

As a further improvement of the present invention, the sliding groove A of the first guide groove is longer than the sliding groove B.

The present invention has the following beneficial effects: as the first hinge shaft and the second hinge shaft are disposed on a hinge of the refrigerator, the first guide groove and the second guide groove which are respectively matched with the two hinge shafts are disposed on the door body of the refrigerator, and during opening of the door body, the first hinge shaft applies the acting force to the first guide groove to drive the end, away from the first guide groove, of the second guide groove to approach the second hinge shaft, the door body is displaced in the horizontal direction and does not interfere with a surrounding wall during opening.

DETAILED DESCRIPTION

The present invention will be described in detail below with reference to the embodiments shown in the accompanying drawings. However, these embodiments are not intended to limit the present invention, and modifications in structures, methods, or functions made by those of ordinary skill in the art according to these embodiments are all included in the scope of protection of the present invention.

The terms "upper", "above", "lower", "below", and the like as used herein, which denote spatial relative positions, describe the relationship of a unit or feature relative to another unit or feature in the accompanying drawings for the purpose of illustration. The terms of the spatial relative positions may be intended to include different orientations of the device in use or operation other than the orientations shown in the accompanying drawings. For example, the units that are described as "below" or "under" other units or features will be "above" other units or features if the device in the accompanying drawings is turned upside down. Thus, the exemplary term "below" can encompass both the orientations of above and below. The device may be otherwise oriented (rotated by 90 degrees or facing other directions) and the space-related descriptors used herein are interpreted accordingly.

Besides, it should be understood that although such terms as first and second may be used herein to describe various elements or structures, and these described objects should not be limited by these terms. These terms are only used to distinguish these described objects from one another. For example, a first hinge shaft may be referred to as a second hinge shaft, and similarly, the second hinge shaft may also be referred to as the first hinge shaft, which does not depart from the scope of protection of the present application.

Figure 1:
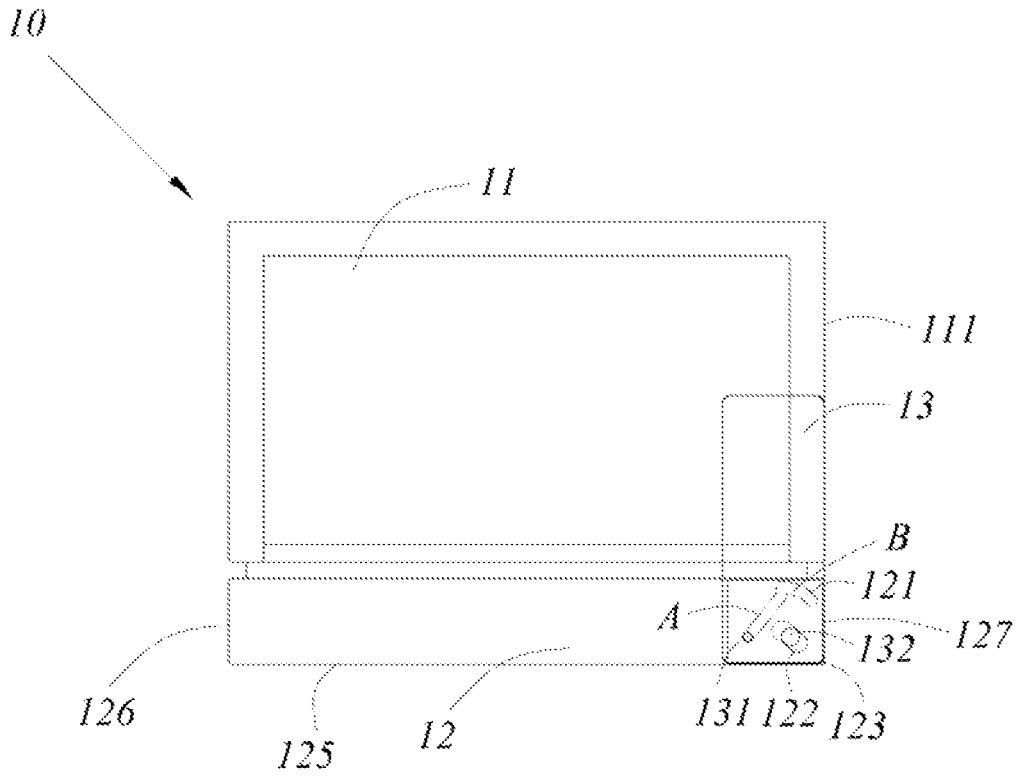
FIG. 1 is a top view showing that a door body of a refrigerator is in a closed state according to one specific embodiment of the present invention.

FIG. 1 illustrates a better embodiment of a refrigerator 10 provided by the present invention. The refrigerator 10 comprises a refrigerator body 11, a door body 12 and a hinge assembly, the door body 12 pivotally connected to the refrigerator body 11 by the hinge assembly. The hinge assembly comprises a hinge body 13 fixed mounted on the refrigerator body 11, as well as a first hinge shaft 131 and a second hinge shaft 132 which are disposed on the hinge body 13. A radius of the first hinge shaft 131 is smaller than that of the second hinge shaft 132. A connecting line of centers of the first hinge shaft 131 and the second hinge shaft 132 is in a horizontal direction.

A first guide groove 121 and a second guide groove 122 are formed in the positions, matched with the hinge assembly, on the door body 12. After installation of the door body 12 and the refrigerator body 11, the first hinge shaft 131 is located in the first guide groove 121, and the second hinge shaft 132 is located in the second guide groove 122. During opening of the door body 12, the first guide groove 121 moves relative to the first hinge shaft 131, and the second guide groove 122 moves relative to the second hinge shaft 132.

Further, the first guide groove 121 is configured as substantially L-shaped and comprises a sliding groove A and a sliding groove B. The sliding groove A is longer than the sliding groove B. The second guide groove 122 is oblong and is disposed opposite to the first guide groove 121. The end, close to the sliding groove A of the first guide groove 121, of the second guide groove 122 is defined as an end C. The end, away from the sliding groove A of the first guide groove 121, of the second guide groove 122 is defined as an end D. It should be noted herein that the oblong shape of the second guide groove 122 means that the end C and the end D take the shapes of symmetrical circular arcs and are connected by two parallel lines between which the distance is greater than or equal to a diameter of the second hinge shaft 132. In the embodiment, the distance between the two parallel lines is roughly equal to the diameter of the second hinge shaft, so that the door body is prevented from an excessive shaking amplitude during opening.

Continuously referring to FIG. 1, when the door body 12 is in a closed state, the first hinge shaft 131 is located at the end, away from the sliding groove B, of the sliding groove A of the first guide groove 121. The second hinge shaft 132 is at a distance away from the end C and the end D of the second guide groove 122. In the embodiment, the second hinge shaft 132 is roughly located in the middle of the second guide groove 122.

Figure 2A:
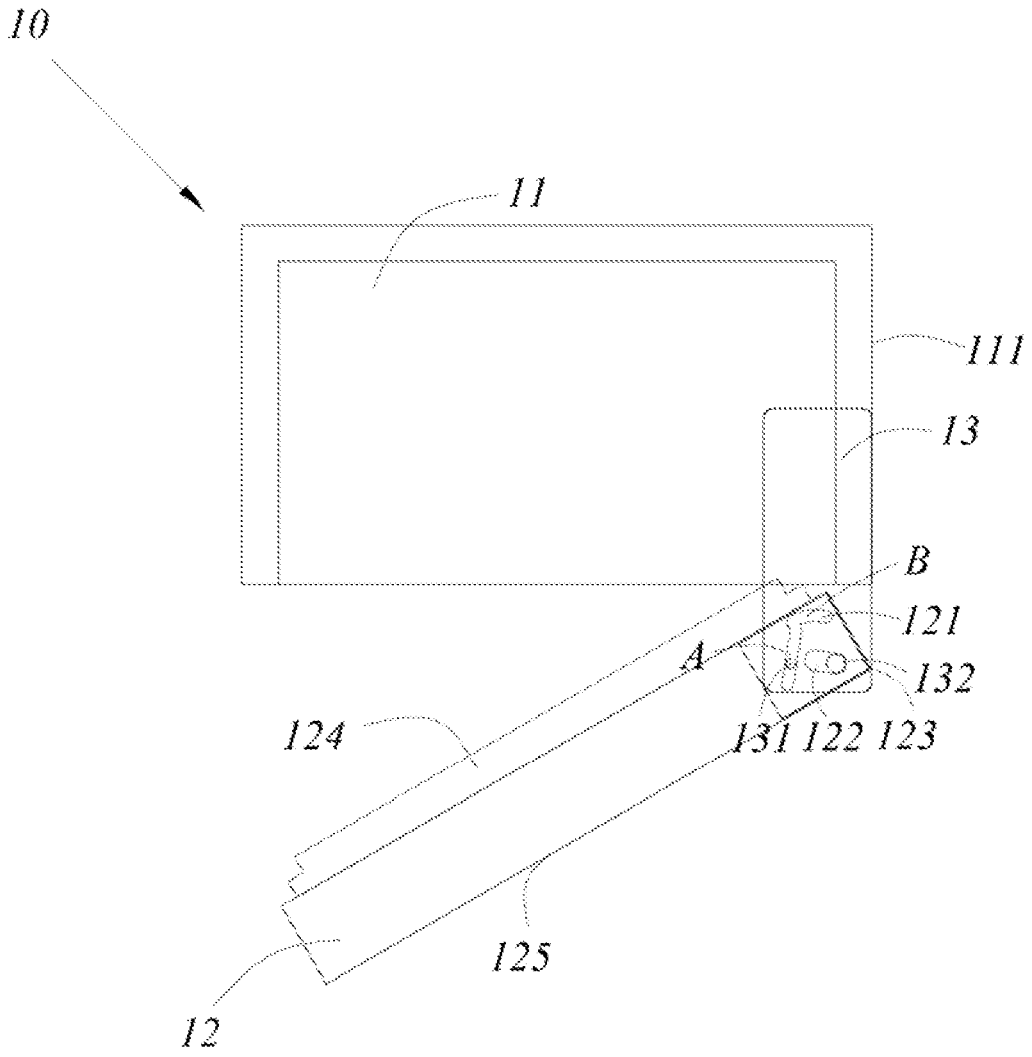
FIGS. 2*a*-2*c* are top views showing that a door body of a refrigerator is at different opening angles of 0-90° according to one specific embodiment of the present invention.
Figure 2B:
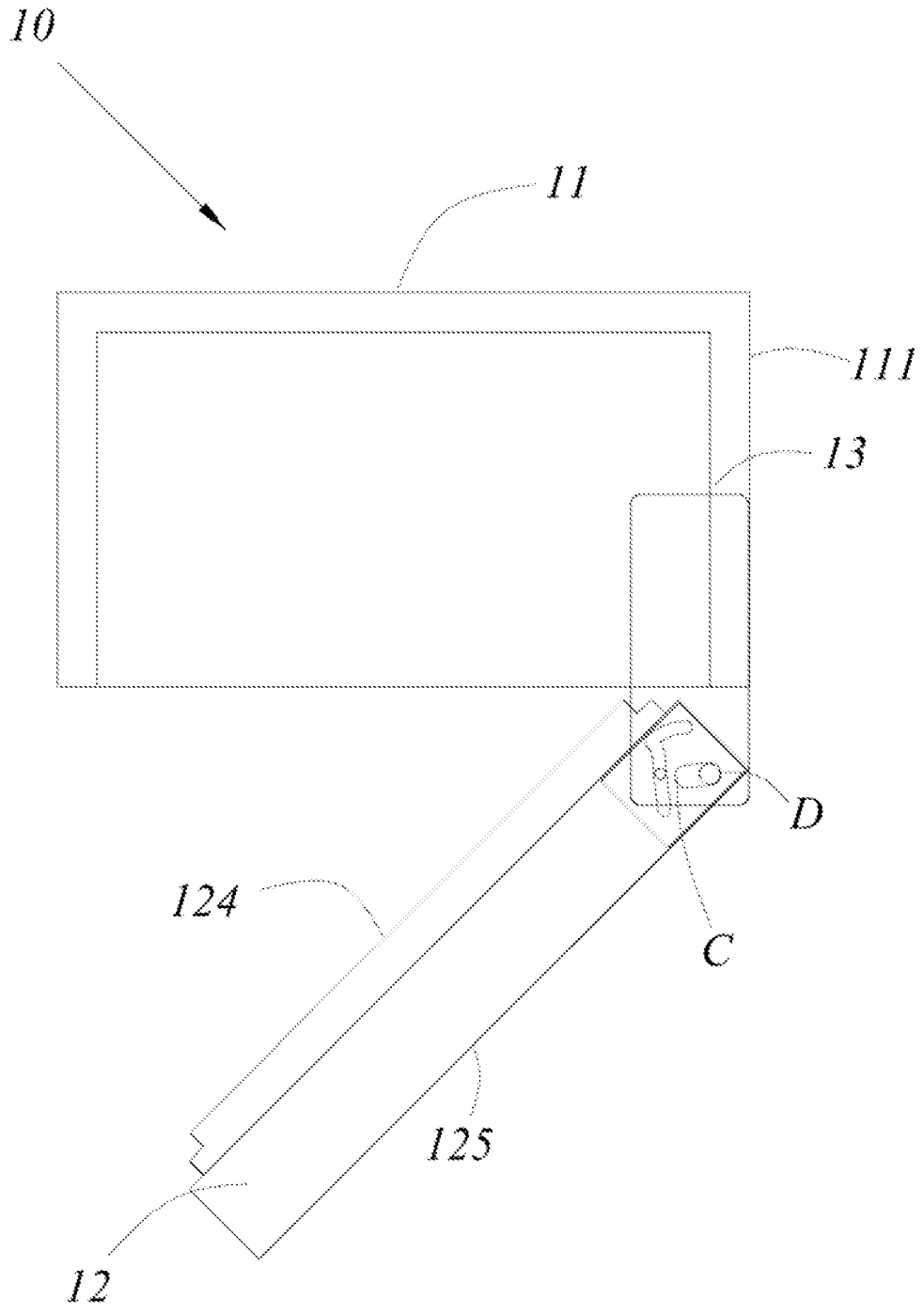
Figure 2C:
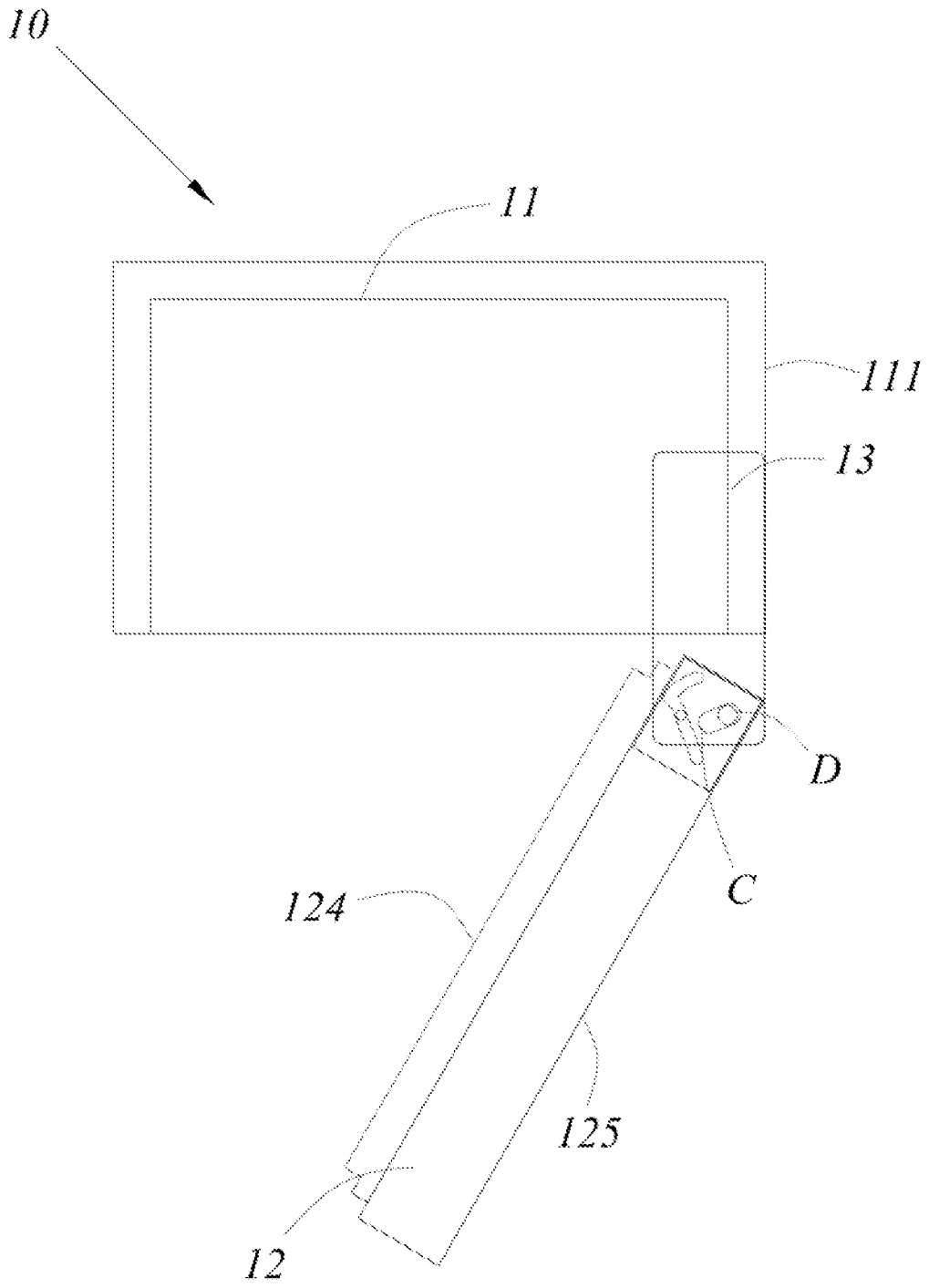

As shown in FIGS. 2*a*-2*c*, when an opening angle of the door body 12 of the refrigerator is smaller than 90° during opening, the first guide groove 121 moves relative to the first hinge shaft 131, but the first hinge shaft 131 is always located in the sliding groove A of the first guide groove 121 and gradually approaches the sliding groove B. During movement, the first hinge shaft 131 applies an acting force to the first guide groove 121 to drive the end D of the second guide groove 122 to gradually approach the second hinge shaft 132, so that the door body 12 is displaced in a horizontal direction. In the embodiment, the end D of the second guide groove 122 gradually approaches the second hinge shaft 132, so that the door body 12 is subjected to a horizontal displacement in a direction away from the hinge component. Further, during movement of the door body 12, a corner 123, close to the second guide groove 122, of the door body never exceeds a plane where a side wall 111, close to the hinge component, of the refrigerator body 11 is located.

Figure 3:
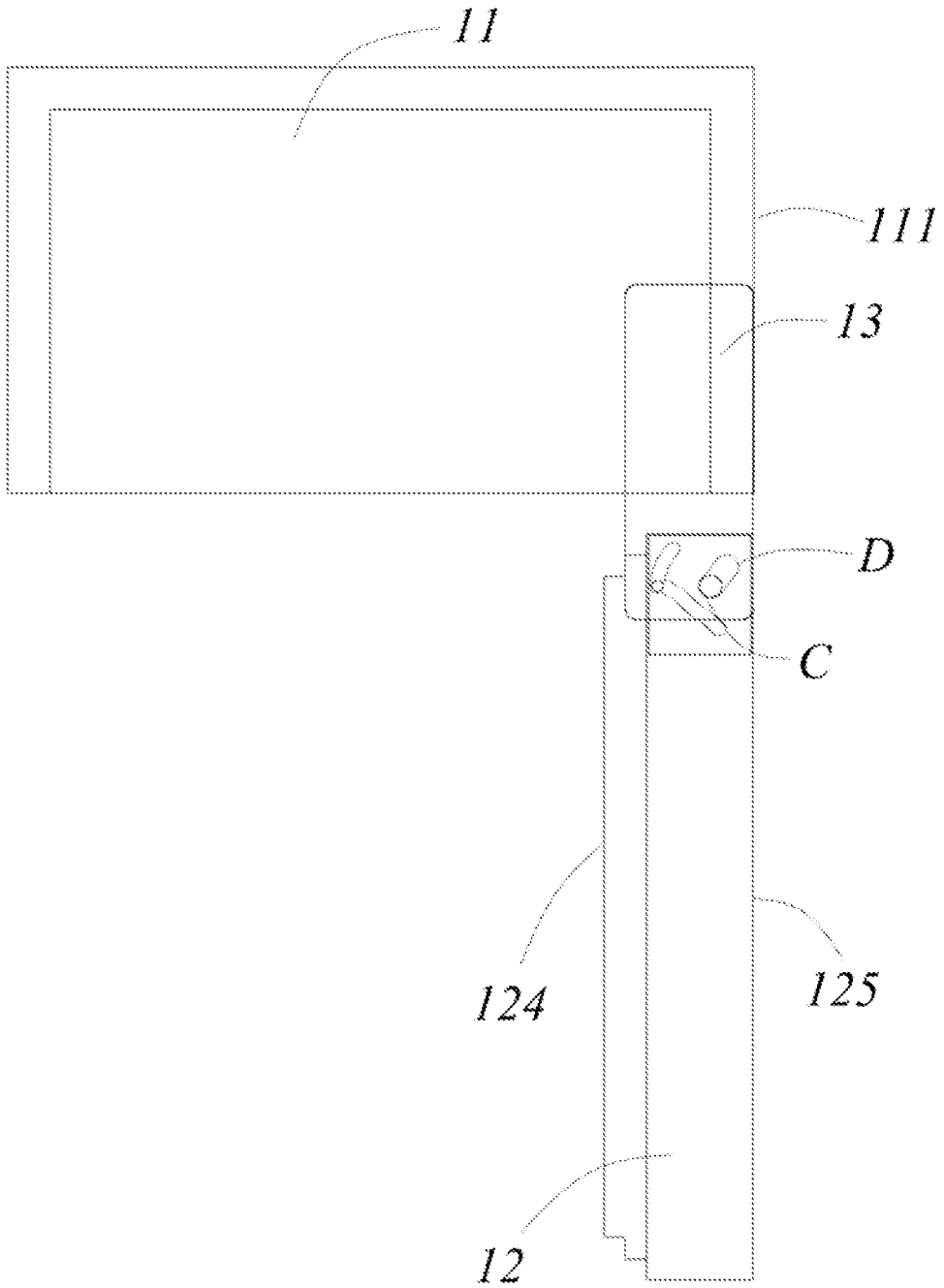
FIG. 3 is a top view showing that a door body of a refrigerator is at an opening angle of 90° according to one specific embodiment of the present invention.

As shown in FIG. 3, when the opening angle of the door body 12 of the refrigerator is 90°, the first hinge shaft 131 is located at a joint of the sliding groove A and the sliding groove B of the first guide groove 121, and the second hinge shaft 132 is located at the end C of the second guide groove 122. The door body 12 is provided with a rear wall 124 and a front wall 125 back to the rear wall 124. The front wall 125 is farther from the refrigerator body 11 than the rear wall 124. A plane where the front wall 125 is located is superimposed with the plane where the side wall 111, close to the hinge component, of the refrigerator body 11 is located. The rear wall 124 and the front wall 125 of the door body 12 are connected by a left wall 126 and a right wall 127 of the door body 12 respectively. The right wall 127 is closer to the hinge component than the left wall 126.

Figure 4A:
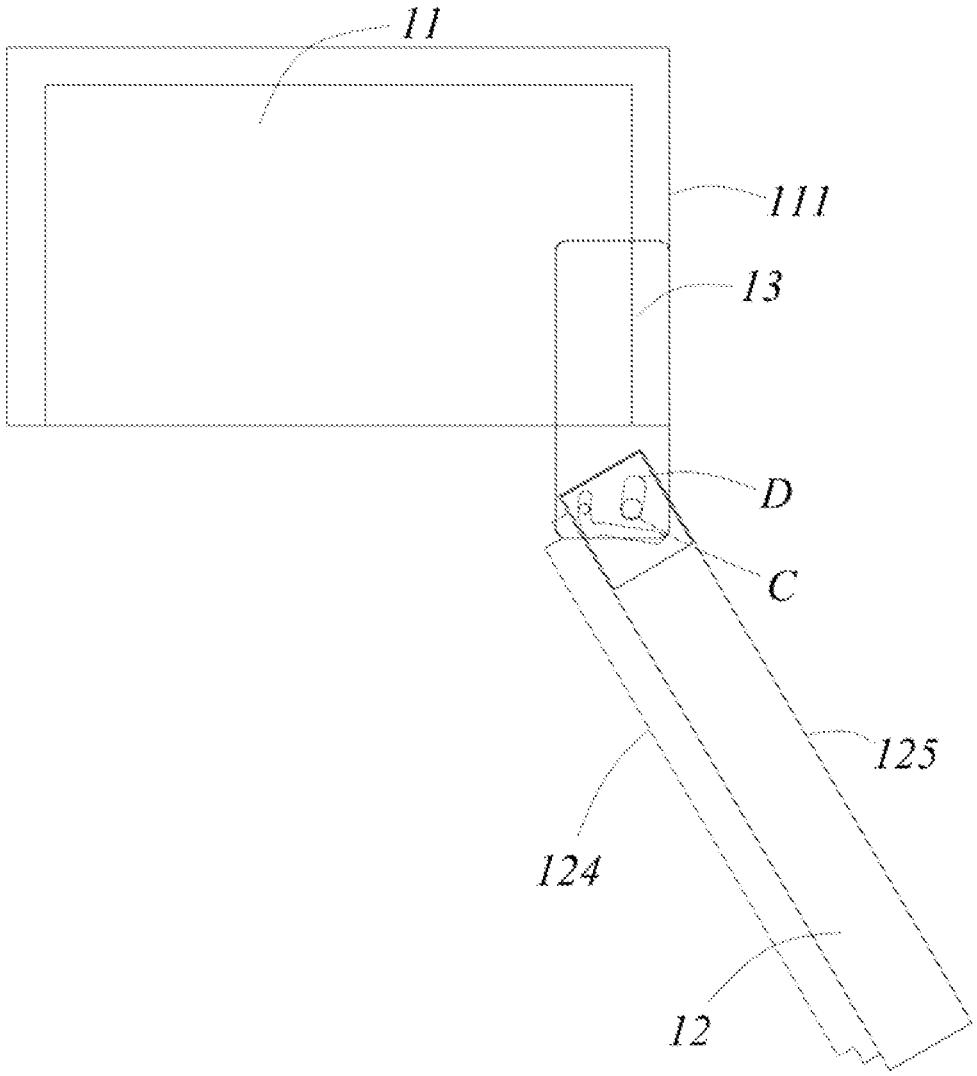
FIGS. 4*a*-4*b* are top views showing that a door body of a refrigerator is at an opening angle greater than 90° according to one specific embodiment of the present invention.
Figure 4B:
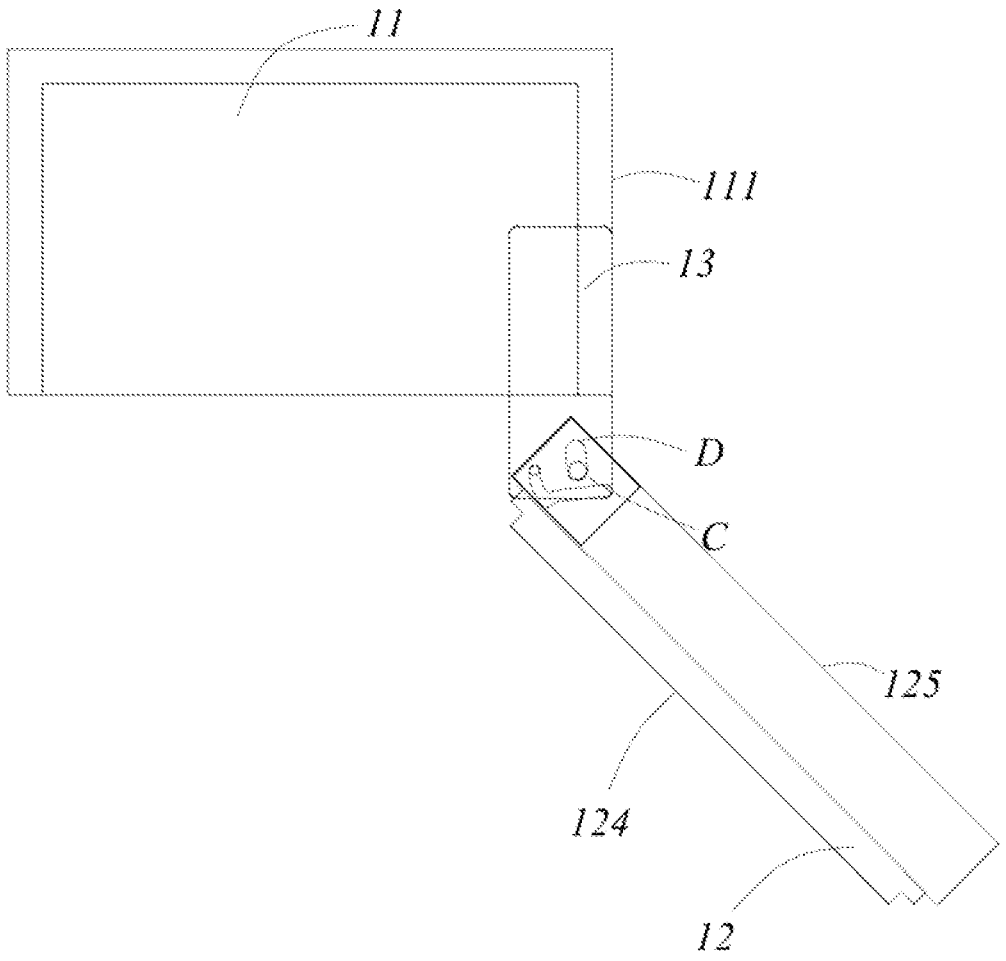
Figure 5A:
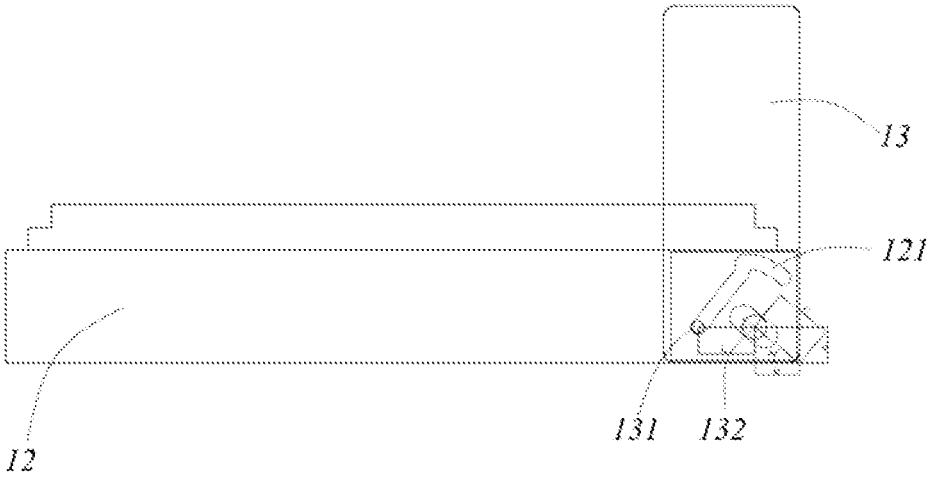
FIGS. 5*a*-5*e* are motion track views showing that a door body of a refrigerator is changed from a closed state to an opening state at different opening angles according to one specific embodiment of the present invention.
Figure 5B:
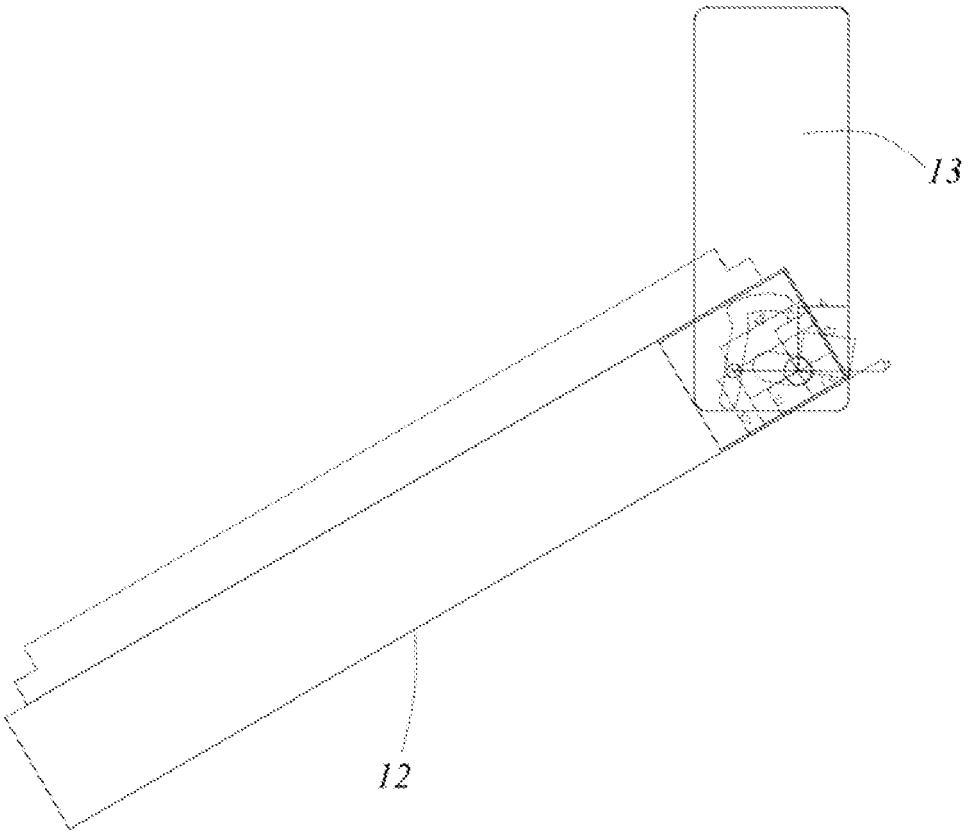
Figure 5C:
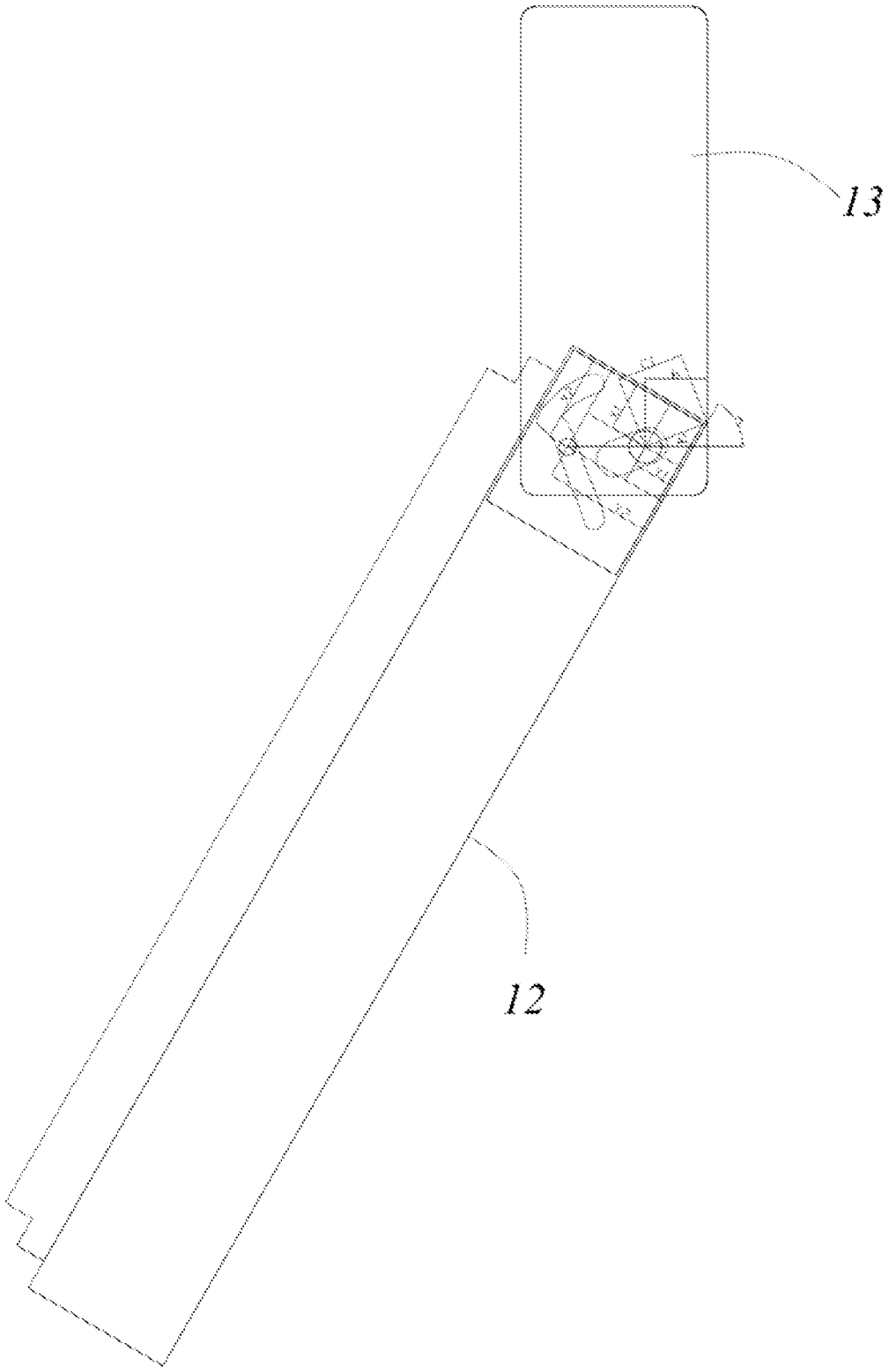
Figure 5D:
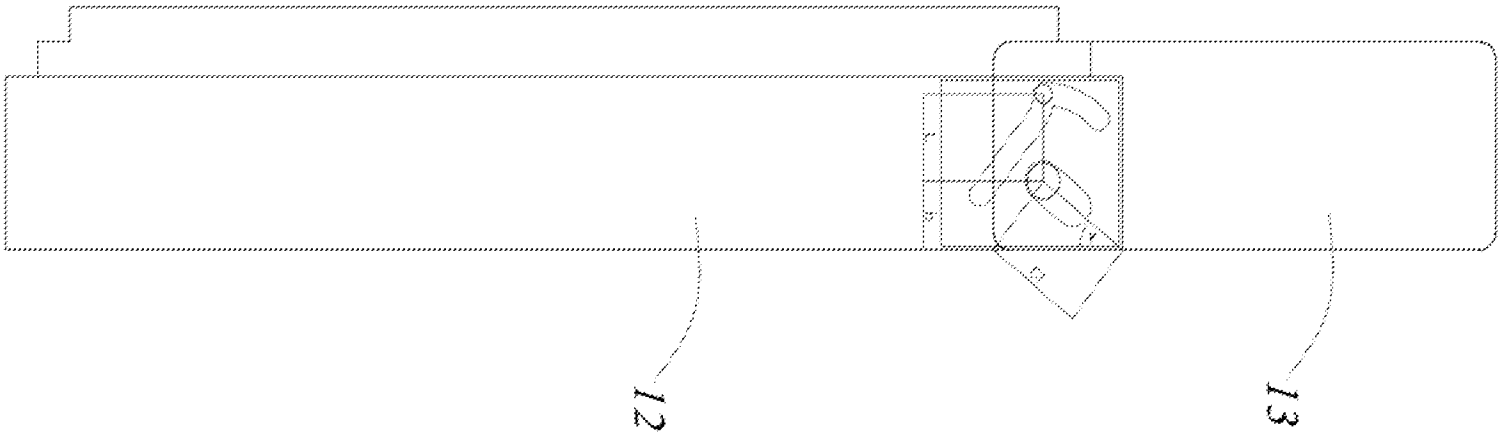
Figure 5E:
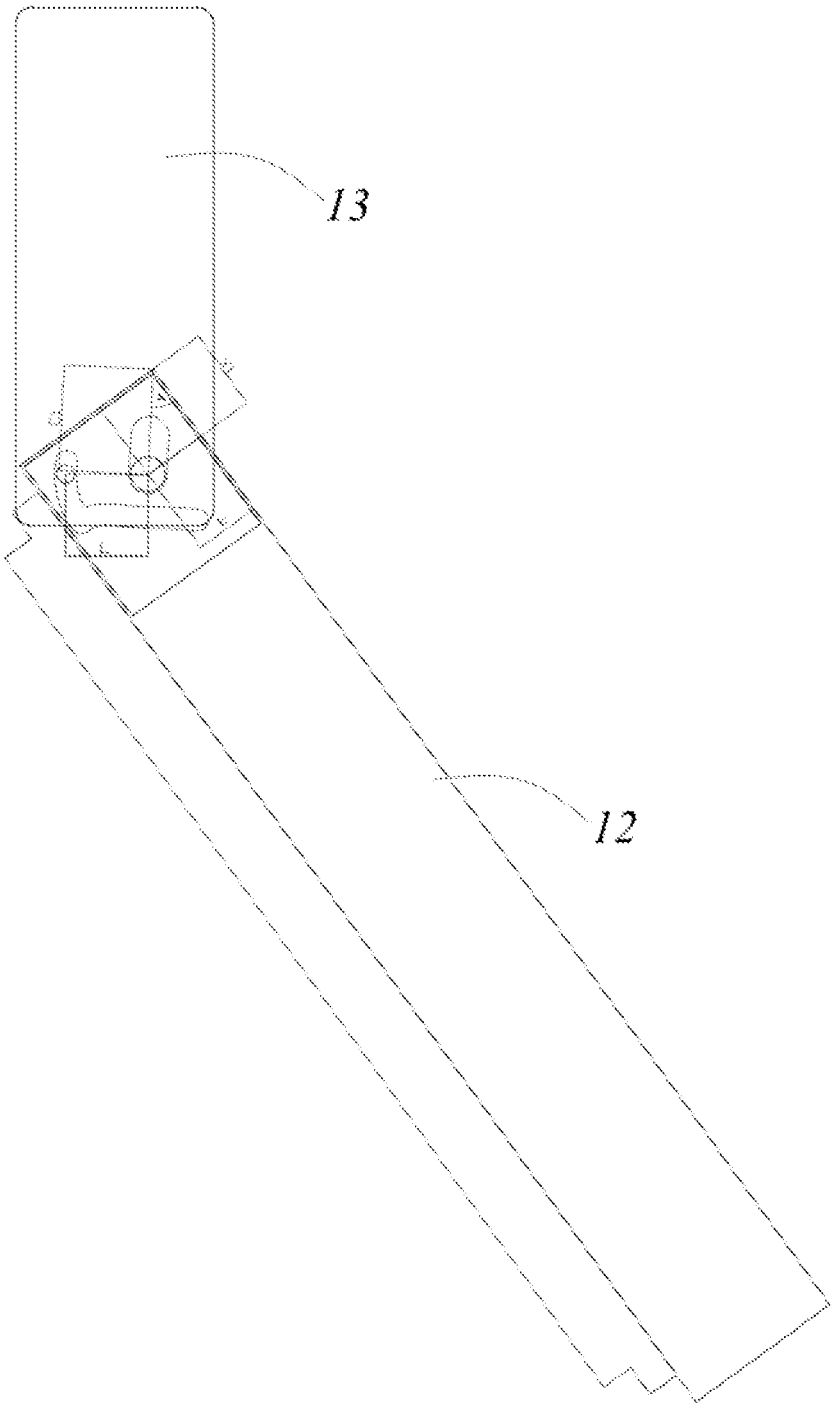

As shown in FIGS. 4*a*-4*b*, when the opening angle of the door body 12 of the refrigerator is greater than 90°, the first hinge shaft 131 is located in the sliding groove B of the first guide groove 121, and the second hinge shaft 132 is located at the end C of the second guide groove 122. At this time, the end corner 123, close to the second guide groove 122, of the door body continuously moves toward the refrigerator body 11.

Moreover, as shown in FIGS. 5*a*-5*e*, the two hinge shafts and the two guide grooves work in cooperation to ensure that during opening at angles of 0-90°, the door body 12 rotates around a traceable variable point of which the track is ($X=(X1+X2)/2$, $Y=(Y1+Y2)/2$). X represents a distance between the variable point and the right wall 127 of the door body. Y represents a distance between the variable point and the front wall 125 of the door body. The motion track of the variable point may be calculated out by the following formula.

When the door body 12 of the refrigerator is in the closed state, a distance between a central point of the second hinge shaft 132 and the front wall 125 of the door body is a, a distance between the central point of the second hinge shaft 132 and the right wall 127 of the door body is b, and a distance between the central point of the second hinge shaft 132 and the end corner 123 of the door body is c.

The relation is that $a^2+b^2=c^2$ and tan $\gamma=a/b$. $\gamma$ is an included angle formed by a plane where an axis of the second guide groove 122 is located and the front wall 125 of the door body 12.

When the door body 12 rotates at an angle of m, $0° \leq m \leq \gamma$, $COS(\gamma-m)=b/C1$. That is, $C1=C1=b/COS(\gamma-m)$.

When the distance between the central point of the second hinge shaft 132 and the right wall 127 of the door body 12 is X1, $X1=C1*COS\ \gamma$.

When the distance between the central point of the second hinge shaft 132 and the front wall 125 of the door body 12 is Y1, $Y1=C1*SIN\ \gamma$.

When a distance between the central point of the first hinge shaft 131 and the right wall 127 of the door body 12 is X2, $X2=C1*COS\ \gamma+L*COS\ m$.

When a distance between the central point of the first hinge shaft 131 and the front wall 125 of the door body 12 is Y2, $Y2=C1*SIN\ \gamma+L*SIN\ m$.

When the door body 12 rotates at the angle of m, $\gamma \leq m \leq 90°$, $COS(m-\gamma)=b/C1$. That is, $C1=b/COS(m-\gamma)$.

When the distance between the central point of the second hinge shaft 132 and the right wall 127 of the door body 12 is X1, $X1=C1*COS\ \gamma$.

When the distance between the central point of the second hinge shaft 132 and the front wall 125 of the door body 12 is Y1, $Y1=C1*SIN\ \gamma$.

When the distance between the central point of the first hinge shaft 131 and the right wall 127 of the door body 12 is X2, $X2=C1*COS\ \gamma+L*COS\ m$.

When the distance between the central point of the first hinge shaft 131 and the front wall 125 of the door body 12 is Y2, $Y2=C1*SIN\ \gamma+L*SIN\ m$.

When the door body 12 rotates at the angle of m, $m \geq 90°$, the door body 12 will rotate around a fixed point which is the center of the second hinge shaft 132.

When the distance between the central point of the second hinge shaft 132 and the right wall 127 of the door body 12 is X1, $X1=C1*COS\ \gamma=b*COS\ \gamma/COS(90°-\gamma)$.

When the distance between the central point of the second hinge shaft 132 and the front wall 125 of the door body 12 is Y1, $Y1=C1*SIN\ \gamma=b*SIN\ \gamma/COS(90°-\gamma)$.

The central point of the first hinge shaft 131 rotates on a circular arc, which takes the central point of the second hinge shaft 132 as the center of a circle and a fixed length L as the radius.

In the forgoing computational formula, L is the distance between the central point of the first hinge shaft 131 and the central point of the second hinge shaft 132.

The variable point is traceable and has the track of $(X=(X1+X2)/2,\ Y=(Y1+Y2)/2)$. X represents a distance between the variable point and the right end of the door body. Y represents a distance between the variable point and a front end of the door body.

It is obvious for those skilled in the art that the present invention is not limited to the details of the above exemplary embodiments, and the present invention can be embodied in other specific forms without departing from the spirit or essential characteristics of the invention. Therefore, the embodiments shall be considered as illustrative and not restrictive from any point. The scope of the invention is defined by the appended claims rather than the above illustration. Hence, all changes falling in the meaning and scope of equivalent elements of the claims are included in the present invention. Any reference number in the claims should not be regarded as a limitation to the involved claims.

In addition, it should be understood that although the description is described according to the embodiments, not every embodiment includes only one independent technical solution, that such a description manner is only for the sake of clarity, that those skilled in the art should take the description as an integral part, and that the technical solutions in the embodiments may be suitably combined to form other embodiments understandable by those skilled in the art.

What is claimed is:

1. A hinge assembly, which is used to connect a refrigerator body and a door body, the door body comprises a front wall arranged away from the refrigerator body, the hinge assembly comprising: a second guide groove and a second hinge shaft located in the second guide groove, the second guide groove comprises an end C and an end D which are opposite arranged, when the door body is opened from a closed state to a first angle, the second hinge shaft moves to the end D, and when the second guide groove is located at the door body, the end C is farther from the front wall compared to the end D;

wherein when the door body is opened from the first angle to a second angle, the second hinge shaft moves to the end C.

2. The hinge assembly according to claim 1, wherein the door body comprises a right wall arranged close to and spaced from the hinge assembly, and arranged neighboring the front wall, when the second guide groove is located at the door body and the door body is in the closed state or is opened from the closed state to the first angle, the end C is farther from the right wall compared to the end D.

3. The hinge assembly according to claim 1, wherein the second guide groove is oblong.

4. The hinge assembly according to claim 3, wherein when door body is in the closed state, an acute angle is formed by a plane where an axis of the second guide groove is located and the front wall.

5. The hinge assembly according to claim 1, wherein the second angle is 90°.

6. The hinge assembly according to claim 1, wherein when the door body is opened continuously from the second angle, the second hinge shaft is maintained at the end C.

7. The hinge assembly according to claim 1, wherein when door body is in the closed state, the second hinge shaft is at a distance away from the end C and the end D of the second guide groove.

8. The hinge assembly according to claim 7, wherein when the door body is in the closed state, the second hinge shaft is located in the middle of the second guide groove.

9. The hinge assembly according to claim 1, wherein the hinge assembly further comprises a first guide groove and a first hinge shaft located in the first guide groove.

10. The hinge assembly according to claim 9, wherein the first hinge shaft is located at one of the refrigerator body and the door body, the first guide groove is located at the other of the refrigerator body and the door body, the second hinge shaft is located at one of the refrigerator body and the door body, the second guide groove is located at the other of the refrigerator body and the door body.

11. The hinge assembly according to claim 9, wherein the first hinge shaft and the second hinge shaft are located at a refrigerator body, and the first guide groove and the second guide groove are located at a door body, the first guide groove comprises a sliding groove A, and the end C is closer to the sliding groove A compared to the end D.

12. The hinge assembly according to claim 11, wherein the door body comprises a right wall arranged close to the hinge assembly, the second guide groove is located at a side of the sliding groove A near the right wall.

13. The hinge assembly according to claim 11, wherein the sliding groove A comprises a first position and a second position, when the door body is opened from the closed state to the first angle, the first hinge shaft moves to the second position from the first position, and the first position is closer to the front wall compared to the second position.

14. The hinge assembly according to claim 13, wherein the door body comprises a right wall arranged close to the hinge assembly, the first position is farther from the right wall compared to the second position.

15. The hinge assembly according to claim 14, wherein the sliding groove A further comprises a third position closer to the right wall and farther from the front wall compared to the second position, when the door body is opened from the first angle to a second angle, the second hinge shaft moves to the end C, and the first hinge shaft moves to the third position.

16. The hinge assembly according to claim 15, wherein the first guide groove is configured as substantially L-shaped and further comprises a sliding groove B connected to the sliding groove A, when the door body is opened continuously from the second angle, the second hinge shaft is maintained at the end C, and the first hinge shaft moves in the sliding groove B.

17. A refrigeration apparatus including the hinge assembly of claim 1.

* * * * *